US006655273B2

(12) United States Patent
Bitterich et al.

(10) Patent No.: US 6,655,273 B2
(45) Date of Patent: Dec. 2, 2003

(54) ROTARY PRINTING MACHINE HAVING A FIRST GEARWHEEL AND A SECOND GEARWHEEL WITH A SECURED ROTARY ANGLE POSITION WHEN UNCOUPLED FROM THE FIRST GEARWHEEL

(75) Inventors: Wolfgang Bitterich, Gemmingen (DE); Steffen Derhardt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/026,495

(22) Filed: Dec. 19, 2001

(65) Prior Publication Data

US 2002/0100380 A1 Aug. 1, 2002

(30) Foreign Application Priority Data

Dec. 19, 2000 (DE) ..... 100 63 311

(51) Int. Cl.[7] ..... B41F 5/00

(52) U.S. Cl. ..... 101/216; 101/218; 101/184; 101/182; 101/185; 101/247; 74/414; 74/409; 74/405

(58) Field of Search ..... 101/216, 218, 101/184, 182, 185, 247; 74/414, 409, 405

(56) References Cited

U.S. PATENT DOCUMENTS

| | | | | | |
|---|---|---|---|---|---|
| 3,792,658 | A | * | 2/1974 | Shore et al. | 101/247 |
| 3,817,173 | A | * | 6/1974 | Merbold et al. | 101/218 |
| 4,241,619 | A | * | 12/1980 | Cerny et al. | 74/440 |
| 4,499,826 | A | * | 2/1985 | Regge | 101/181 |
| 4,791,869 | A | * | 12/1988 | Furukawa | 101/232 |
| 4,934,305 | A | * | 6/1990 | Koehler et al. | 118/46 |
| 5,170,707 | A | | 12/1992 | Thoma | |
| 5,562,035 | A | * | 10/1996 | Pollich et al. | 101/232 |
| 5,746,091 | A | | 5/1998 | Schaede | |
| 5,964,150 | A | * | 10/1999 | Kato et al. | 101/216 |
| 5,967,038 | A | | 10/1999 | Feller | |
| 6,062,751 | A | * | 5/2000 | Baum | 400/621 |
| 6,263,793 | B1 | * | 7/2001 | Muth | 101/219 |

FOREIGN PATENT DOCUMENTS

| | | | | |
|---|---|---|---|---|
| DE | 72 19 343 | | 9/1973 | |
| DE | 31 31 392 | A1 | 2/1983 | |
| DE | 3901076 | A1 * | 8/1989 | F16H/55/18 |
| DE | 44 37 145 | A1 | 5/1996 | |
| DE | 197 54 544 | C1 | 7/1999 | |
| DE | 198 20 331 | A1 | 11/1999 | |
| DE | 10013979 | A1 * | 12/2000 | B41F/13/34 |
| EP | 0 475 125 | A1 | 3/1992 | |

* cited by examiner

*Primary Examiner*—Andrew H. Hirshfeld
*Assistant Examiner*—Andrea Hence Evans
(74) *Attorney, Agent, or Firm*—Laurence A. Greenberg; Werner H. Stemer; Gregory L. Mayback

(57) ABSTRACT

A rotary printing machine includes a first gearwheel, a second gearwheel, and a setting device for selectively adjusting the second gearwheel into a first position, in which the gearwheels are coupled to one another, and into a second position, in which the gearwheels are uncoupled from one another. The printing machine includes a traction mechanism for securing a staggered-teeth rotary-angle position of the second gearwheel relative to the first gearwheel when the second gearwheel is adjusted into the second position, and a first tension element for tensioning a rotatably arranged traction means of the traction mechanism. The first tension element is loaded by a spring. The traction means is assigned a second tension element, and in the second tension element is mounted so to be a selectively adjustable into a first switching position and a second switching position.

11 Claims, 4 Drawing Sheets

ROTARY PRINTING MACHINE HAVING A FIRST GEARWHEEL AND A SECOND GEARWHEEL WITH A SECURED ROTARY ANGLE POSITION WHEN UNCOUPLED FROM THE FIRST GEARWHEEL

BACKGROUND OF THE INVENTION

FIELD OF THE INVENTION

The present invention relates to a rotary printing machine which includes a first gearwheel, a second gearwheel, and a setting device for adjusting the second gearwheel relative to the first gearwheel. The setting device selectively adjusts the second gearwheel into a first position, in which the first and second gearwheels are coupled to one another, and into a second position, in which the first and second gearwheels are uncoupled from one another. The printing machine also includes a traction mechanism for securing a staggered-teeth rotary-angle position of the second gearwheel relative to the first gearwheel when the second gearwheel is adjusted into the second position, and a first tension element for tensioning a rotatably arranged traction means of the traction mechanism.

German Patent DE 197 54 544 C1 describes a rotary printing machine with a traction mechanism that although keeping the teeth of the gearwheels staggered when the second gearwheel is adjusted into the second position, does not ensure reliable tooth-flank contact, without tooth play, when the second gearwheel is adjusted into the first position.

SUMMARY OF THE INVENTION

It is accordingly an object of the invention to provide a rotary printing machine which overcomes the above-mentioned disadvantages of the prior art apparatus of this general type.

In particular it is an object of the invention to provide a rotary printing machine which corresponds to the generic type initially mentioned and which has a traction mechanism that not only keeps the teeth staggered when the second gearwheel is uncoupled, but also ensures reliable tooth-flank contact, without tooth play, when the gearwheels are coupled to one another.

With the foregoing and other objects in view there is provided, in accordance with the invention, a rotary printing machine, that includes: a first gearwheel; a second gearwheel; a setting device for selectively adjusting the second gearwheel into a first position in which the second gearwheel is coupled with the first gearwheel and into a second position in which the second gearwheel is uncoupled from the first gearwheel; and a traction mechanism for securing a staggered-teeth rotary-angle position of the second gearwheel relative to the first gearwheel when the second gearwheel is adjusted into the second position. The traction mechanism includes rotatably configured traction means. The traction mechanism includes a first tension element for tensioning the traction means. The traction mechanism includes a spring that loads the first tension element. The traction mechanism includes a second tension element assigned to the traction means. The second tension element is mounted to be selectively adjustable into a first switching position and a second switching position.

In accordance with an added feature of the invention, a stop is provided that predetermines the first switching position.

In accordance with an additional feature of the invention, the stop is an adjustable stop.

In accordance with another feature of the invention, a setting drive is assigned to the second tension element; and the setting drive is for adjusting the second tension element into the first switching position and into the second switching position.

In accordance with a further feature of the invention, the setting drive is a pneumatic working cylinder.

In accordance with a further added feature of the invention, the second tension element is a tension roller.

In accordance with a further additional feature of the invention, the traction means rotates along a path; and the first tension element is configured inside the path.

In accordance with yet an added feature of the invention, the traction means has a first portion and a second portion; the first tension element is assigned to the first portion of the traction means; and the second tension element is assigned to the second portion of the traction means.

A particular advantage of the rotary printing machine is the multifunctional use of the traction means. The latter serves both for securing a correct rotary-angle position of the second gearwheel relative to the first gearwheel when the gearwheels are uncoupled from one another, and for bracing the gearwheels with one another when they are coupled.

Other features which are considered as characteristic for the invention are set forth in the appended claims.

Although the invention is illustrated and described herein as embodied in Rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
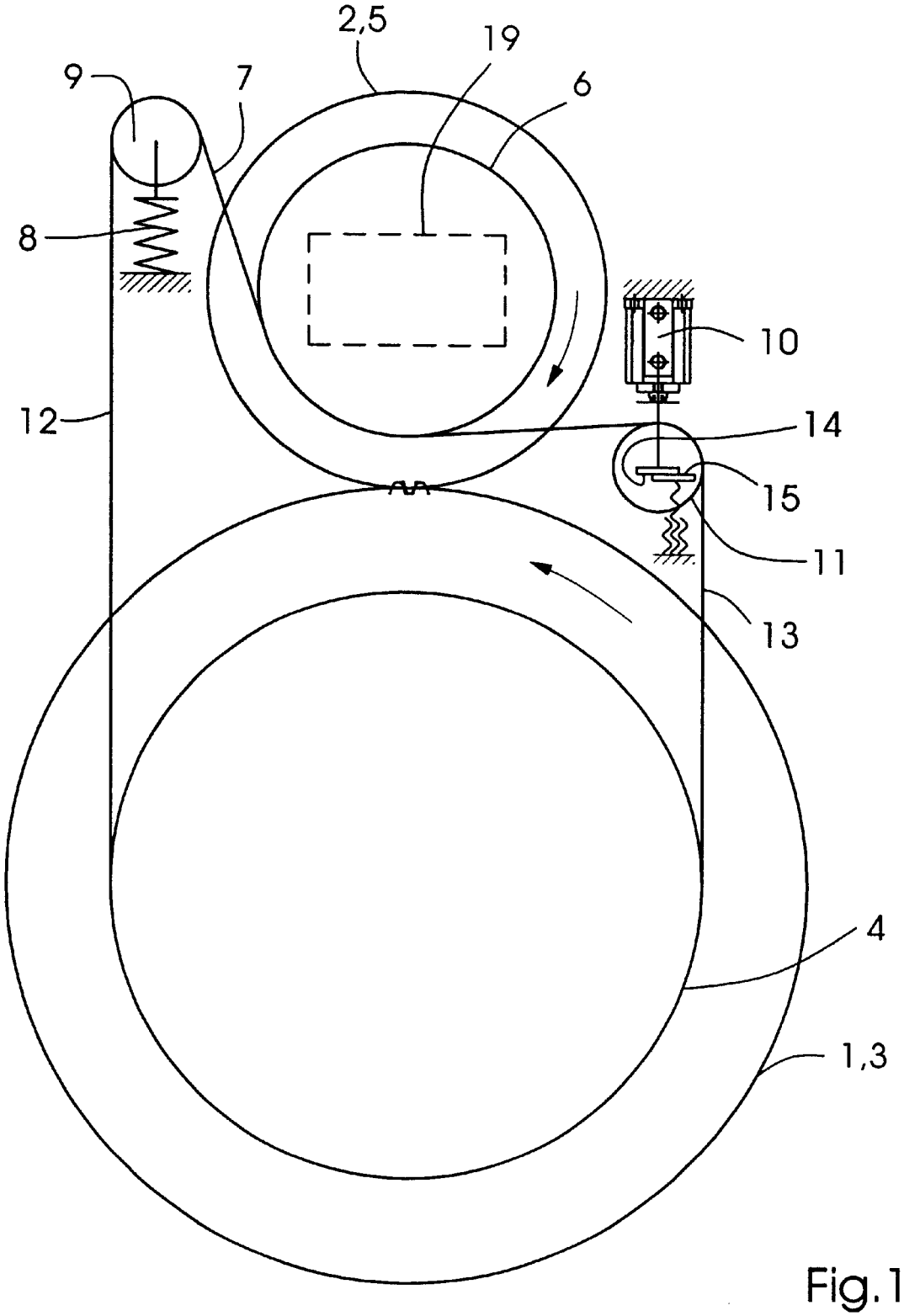
FIG. 1 shows a portion of a rotary printing machine in which a traction means loops around two wheels and is held under tension by two tension elements.

Referring now to the figures of the drawing in detail and first, particularly, to FIG. 1 thereof, there is shown a portion of a rotary printing machine for processing print carrier sheets. The portion shows a coating unit of the rotary printing machine that can be used for printing or varnishing. The coating unit includes a first cylinder 1 and a second cylinder 2. The first cylinder 1 is an impression cylinder equipped with grippers for holding the print carrier sheets and has double-sized dimensioning. The second cylinder 2 has single-sized dimensioning. A rubber blanket for full-area varnishing work or a flexographic printing plate for spot varnishing may be selectively tension-mounted onto second cylinder 2.

The first cylinder 1, a first gearwheel 3, and a first wheel 4 are arranged coaxially with one another and are fixedly connected to one another with regard to rotation. The second cylinder 2, a second gearwheel 5, and a second wheel 6 are likewise arranged coaxially with one another and are fixedly connected to one another with regard to rotation. The first gearwheel 3 and the second gearwheel 5 are integral parts of a gearwheel mechanism, via which the cylinders 1, 2 are driven in rotation during the printing operation. In the drawing, circular lines associated with the reference symbols "1", "2", "3" and "5" represent both circumferential contours of the cylinders 1, 2 and reference circles of the gearwheels 3, 5 toothed on the end face, respectively. The reference circles have the same diameter as the circumferential contours. The intermeshing toothings of the gearwheels 3, 5 are indicated only in the circumferential angle region of the printing nip formed by the cylinders 1, 3. The wheels 4, 6, too, which are likewise designed as gearwheels that have toothed end faces, are illustrated diagrammatically in FIGS. 1 and 2 merely by means of their reference circles.

The second cylinder 2 is mounted to be selectively adjustable using a setting device 19, for example, an eccentric bush, into an illustrated throw-on position on the first cylinder 1 and into a cylinder position, diagrammatically illustrated (see reference symbols 2', 5'), in which the second cylinder 2 is retracted from the first cylinder 1 and in which the second gearwheel 5 is completely out of tooth engagement with the first gearwheel 3. In the cylinder position, the second cylinder 2 is driven in rotation solely by a planar traction mechanism. The traction mechanism includes, in addition to the wheels 4, 6, a traction device or means 7 that is arranged rotatably about the latter and is closed on itself.

It is possible for the traction means 7, which loops around the wheels 4, 6 and which is capable of transmitting forces only by traction, and not by compression, to be designed as a flexible or multimembered traction means, such as for example, a toothed belt or an articulated chain, that is positively coupled, that is to say meshes, with the wheels 4, 6. The wheels 4, 6 may function as belt wheels, if the traction means 7 is a belt, or function as chain wheels, if the traction means 7 is a chain.

The traction means 7 illustrated in the drawing is an internally and externally toothed endless toothed belt which is flexible and which is in meshing engagement with the wheels 4, 6. The run of the traction means 7 is selected such that the first wheel 4 bears on the inside and the second wheel 6 on the outside of the traction means 7.

The traction mechanism also includes a first tension element 9 held in permanent bearing contact on the traction means 7 by a spring 8, and a second tension element 11 mounted to be adjustable by a remotely operable setting drive 10 selectively into a first switching position and a second switching position. The sprung first tension element 9 is designed as a tension roller and is assigned to a first portion 12 of the traction means 7 and bears on the inside of the latter. The switchable second tension element 11 is likewise designed as a tension roller and is assigned to a second portion 13 of the traction means 7. The setting drive 10 is a double-acting pneumatic working cylinder with an extendable and retractable lifting piston.

By adjusting the second tension element 11 out of the illustrated first switching position and into the non-illustrated second switching position, a contact surface 14 is lifted off of an adjustable stop 15, for example, a stop screw that determines the first switching position, and the tension of the traction means 7 is increased. The contact surface 14 formed on the setting drive 10 is located on a piston rod of the setting drive 10. The tension element 11 is fastened to the piston rod via a rotary joint. Instead of providing an adjustable stop 15, it may be provided that the rotary-angle position of the wheel 4 can be adjusted relative to the gearwheel 3 and/or that the rotary-angle position of the wheel 6 can be adjusted relative to the gearwheel 5.

Figure 2:
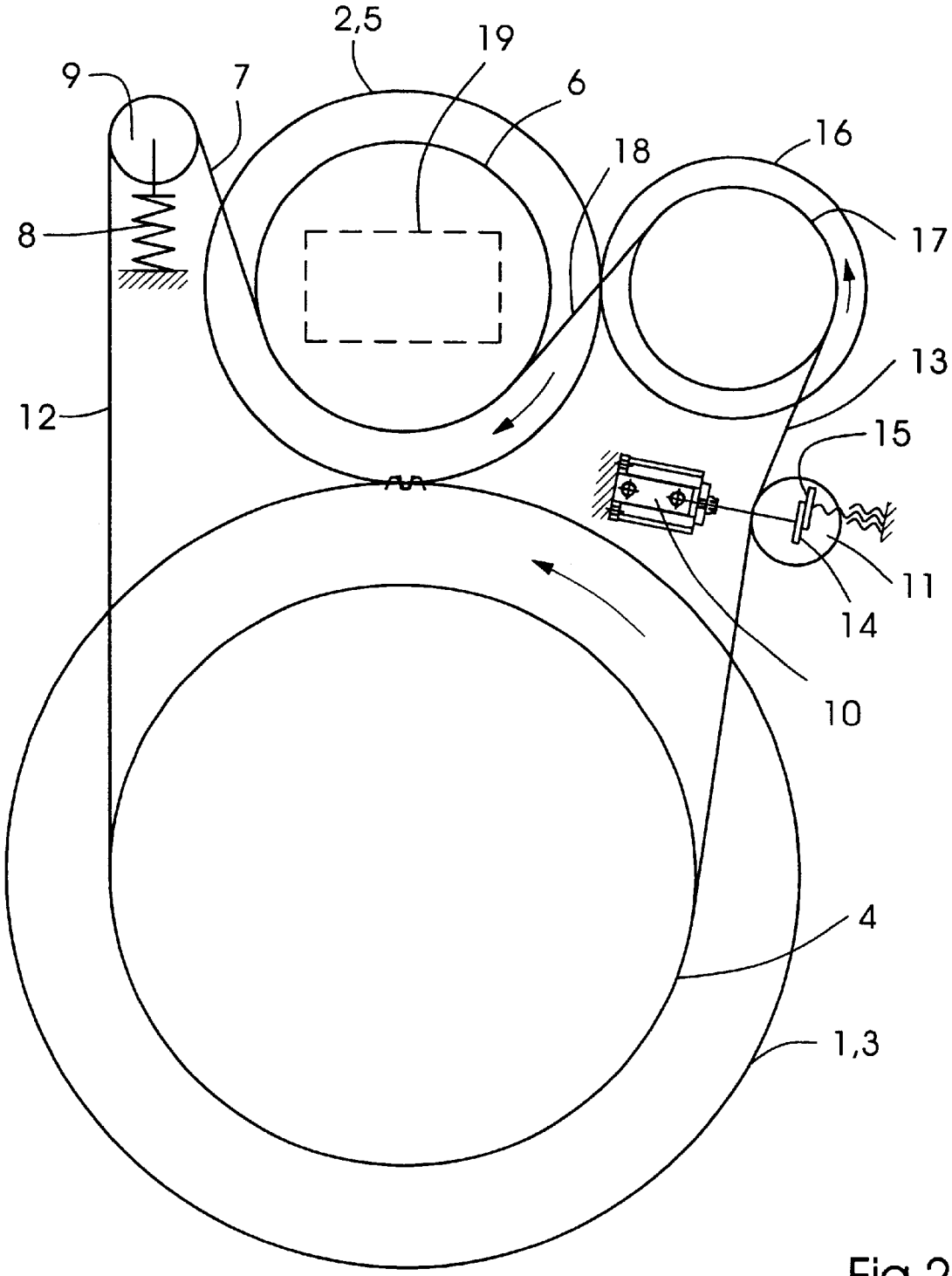
FIG. 2 shows a modified version of the portion of the rotary printing machine in which the traction means loops around a further wheel.
Figure 3:
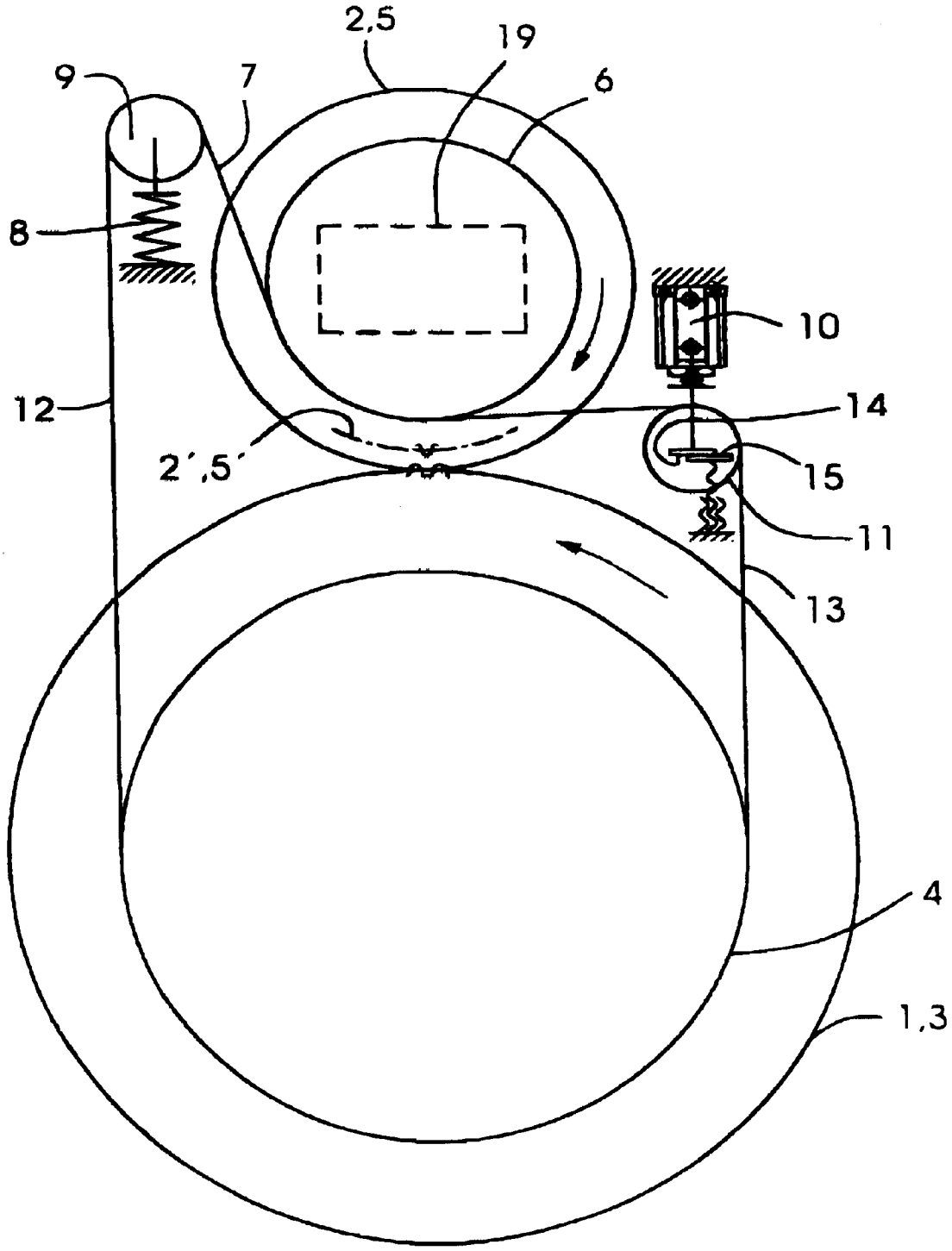
FIG. 3 shows a portion of a rotary printing machine in which the second cylinder is in a second position and a traction means loops around two wheels and is held under tension by two tension elements.
Figure 4:
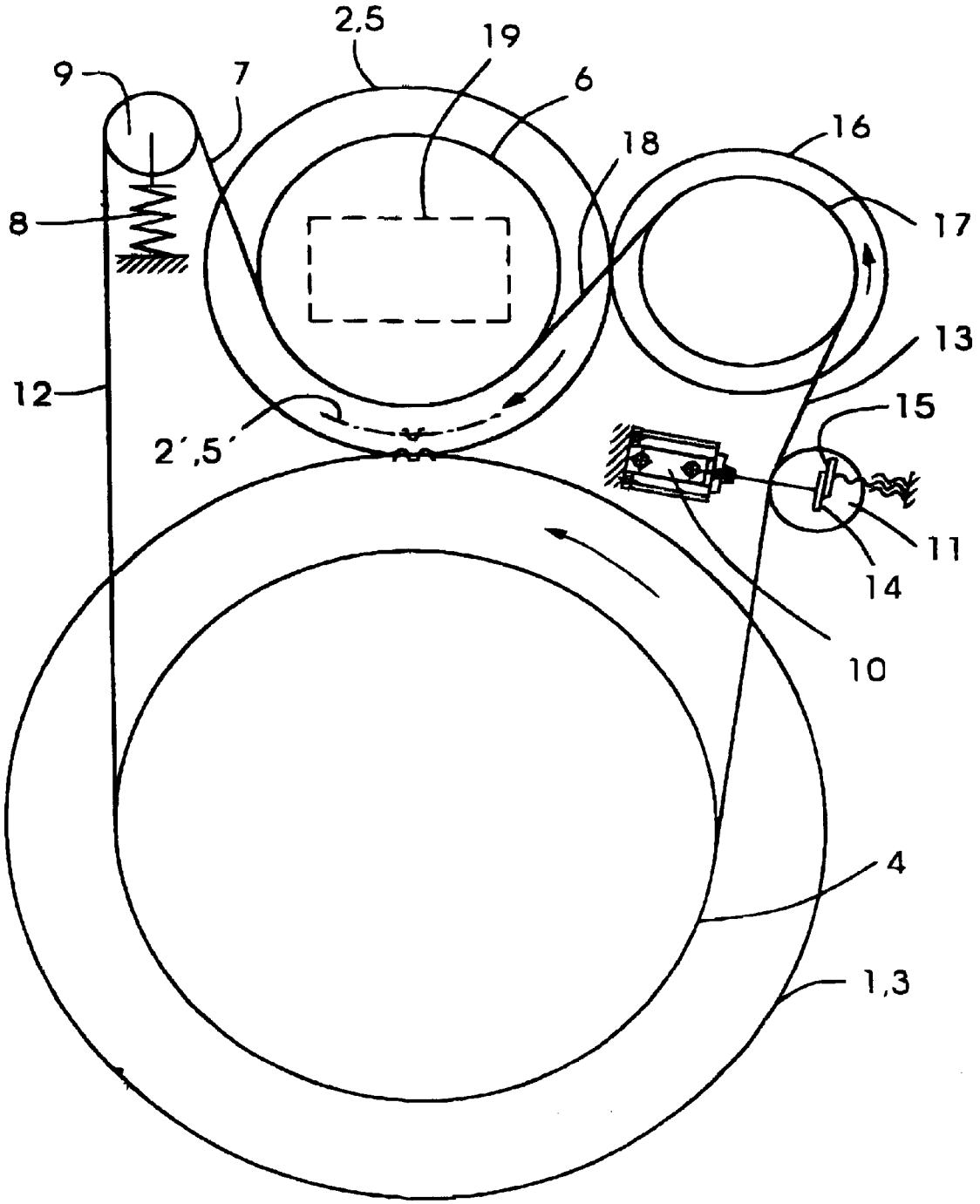
FIG. 4 shows a modified version of the portion of the rotary printing machine in which the second cylinder is in a second position and the traction means loops around a further wheel.

FIG. 2 shows a second exemplary embodiment of the invention that has all of the features described above in connection with the first exemplary embodiment shown in FIG. 1.

Structural particulars, in which the two exemplary embodiments illustrated in FIGS. 1 and 2 differ from one another, are described below.

In the first exemplary embodiment illustrated in FIG. 1, the second tension element 11 bears on the inside of the traction means 7. The traction means 7 thus runs over three elements arranged on the inside of the path of the traction means 7. To be precise, the inside of the traction means 7 is guided over the first wheel 4 and the tension elements 9, 11, and the outside of the tension means 7 is guided over the second wheel 6. The second portion 13 starts at the second wheel 6 and ends at the first wheel 4.

In the second exemplary embodiment which illustrates a modification of the first exemplary embodiment and which is shown in FIG. 2, the second tension element 11 bears on the outside of the traction means 7. Moreover, a roller 16 is in rolling contact with the second cylinder 2, more specifically with the flexographic printing plate or the rubber blanket on the second cylinder 2. The roller 16 is an ink applicator and/or an engraved roller. A third wheel 17, like each of the wheels 4, 6, is designed as a belt wheel with a toothed end face. The third wheel 17 is arranged coaxially with the roller 16 and the third wheel 17 and the roller 16 are fixedly connected to one another with regard to rotation.

The traction means 7 which is in meshing engagement with the third wheel 17 and loops around the third wheel 17 is guided so that the third wheel 17 bears on the inside of the traction means 7. According to the second exemplary embodiment, therefore, the traction means 7 runs over three elements arranged on the inside of the traction means 7, to be precise the wheels 4, 17 and the first tension element 9. The traction means 7 is guided over two elements that arranged on the outside of the traction means 7, to be precise the second wheel 6 and the second tension element 11. The second portion 13 of the traction means 7 starts at the third wheel 17 and ends at the first wheel 4. A third portion 18 of the traction means 7 starts at the second wheel 6 and ends at the third wheel 17.

The operation of both exemplary embodiments, is explained below:

The coating unit is arranged downstream of at least one printing unit, such as, for example, a flexographic or offset printing unit, of a rotary printing machine, as seen in the print carrier transport direction. The rotary printing machine is capable of being operated in a first and a second operating mode.

In the first operating mode, in a single printing pass, the print carrier sheets are first printed in the at least one printing unit and are then varnished in the coating unit. According to the second operating mode, the print carrier sheets, although they are printed in the at least one printing unit, are transported through the coating unit, without being varnished in the latter.

The coating unit is actively tied into the inline process in the first operating mode, and inactively tied into the inline process in the second operating mode. In order to change from the first operating mode to the second operating mode, it is necessary to use the setting device 19 to adjust the second cylinder 2 out of the print-on position and into the cylinder position in which the second cylinder 2 is retracted from the first cylinder 1. During this adjustment, the second cylinder 2 and the second gearwheel 5 are adjusted together out of a first position, in which the second gearwheel 5 is in engagement with the first gearwheel 3, and into a second position, in which the second gearwheel 5 is out of engagement with the first gearwheel 3. The uncoupling of the second gearwheel 5 from the first gearwheel 3 makes it possible to set a very large clearance between the cylinders 1, 2. This clearance ensures that the leading edge of the print carrier sheet can be held in the grippers of the rotating first cylinder 1 and can be transported, free of smudging, past the likewise rotating second cylinder 2, without the trailing edge of the print carrier sheet knocking against the second cylinder 2 at the same time. The trailing edge projects somewhat from the first cylinder 1 as a result of a print carrier sheet with a high rigidity, for example, a cardboard sheet, and as a result of the centrifugal force effect.

The following method steps are carried out in the order of their listing, in order to change the coating unit from the first operating mode to the second operating mode.

In a first method step, the setting drive 10 is used to adjust the second tension element 11. The piston rod of the setting drive 10 is in this case extended, out of the second switching position into the first switching position, and consequently the second gearwheel 5 is rotated relative to the first gearwheel 3. At the same time, the second gearwheel 5 is rotated out of a first rotary position, in which a tooth of the second gearwheel 5 is engaged into a tooth space of the first gearwheel 3 and is in tooth-flank contact with one of two teeth of the first gearwheel 3 which delimit the tooth space, and into a second rotary position, in which the tooth of the second gearwheel 5 is out of tooth-flank contact with each of the two teeth of the first gearwheel 3. In the first method step, the second portion 13 is de-tensioned as a result of the adjustment of the first tension element 9 and is shortened by virtue of the rotation of the second gearwheel 5, and simultaneously, the first portion 12 is lengthened by virtue of the rotation of the second gearwheel 5, and with a decreasing tension of the spring 8, is re-tensioned via the first tension element 9.

In a subsequent second method step, the setting device 19 is used to adjust the second gearwheel 5 relative to the first gearwheel 3. In the second method step, the second gearwheel 5 is adjusted out of the first position into the second position, away from the first gearwheel 3, with the result that the tooth of the second gearwheel 5 is drawn out of the tooth space of the first gearwheel 3.

In other words, in both method steps, the following takes place: the second tension element 11 is adjusted from the second switching position in which the contact surface 14 has a clearance relative to the stop 15, and into the first switching position in which the contact surface 14 bears on the stop 15. As a result of this adjustment, the tractive tension of the traction means 7 is reduced in the region of the second portion 13, thus making it possible for the spring 8 to experience detensioning. As a consequence of this, the second portion 13 is tautened again and the second gearwheel 5 is rotated somewhat clockwise in relation to FIGS. 1 and 2. However, the second gearwheel 5 is rotated only to an extent such that a trailing tooth flank of the second gearwheel 5 is lifted off from a leading tooth flank of the first gearwheel 3, and the tooth of the second gearwheel 5 which has the trailing tooth flank is set exactly in the middle of the tooth space of the first gearwheel 4. The stop 15 is set in such a way that, even during and after the adjustment of the second gearwheel 5 out of engagement with the first gearwheel 3, the tooth of the second gearwheel 5 essentially maintains its centrally aligned position relative to the tooth space. This position is necessary for renewed engagement into the tooth space, that is to say, a tooth-on-tooth position of the tooth of the second gearwheel 5 with a tooth of the first gearwheel 3 is at all events ruled out.

The actual carrying out of the second operating mode, that is to say printing without varnishing, forms a third method step, in which the second gearwheel 5 is driven in rotation solely via the traction mechanism.

In order to change from the second operating mode back to the first operating mode, it is necessary to have a fourth and a fifth method step that are carried out for the purpose of coupling the second gearwheel 5 to the first gearwheel 3.

In the fourth method step, the setting device 19 is used to adjust the second gearwheel 5, relative to the first gearwheel 3, out of the second position and into the first position. During this adjustment of the second gearwheel 5 relative to the first gearwheel 3, the tooth of the second gearwheel 5 is pushed centrally into the tooth space of the first gearwheel 3, without at the same time, the tooth of the second gearwheel 5 rubbing against a tooth flank of one of the teeth of the first gearwheel 3 that delimits the tooth space.

In the fifth method step, the setting drive 10 is used to adjust the second tension element 11 back by retracting the piston rod of the setting drive 10, and consequently, the second gearwheel 5 is rotated counterclockwise relative to the first gearwheel 3 via the traction mechanism. In the fifth method step, therefore, there is a rotation out of the second rotary position, in which the tooth of the second gearwheel 5 is out of tooth-flank contact with the two teeth of the first gearwheel 3 that delimit the tooth space, and back into the first rotary position, in which the tooth of the second gearwheel 5 is in tooth-flank contact with one of the two teeth of the first gearwheel 3. In the fifth method step, the second portion 13 is tensioned as a result of the adjustment of the second tension element 11 and is lengthened by virtue of the rotation of the second gearwheel 5. Simultaneously, the first portion 12 is shortened by virtue of the rotation of the second gearwheel 5, along with an increasing tension of the spring 8 loading the first tension element 9.

In other words, in the fifth method step, the contact surface 14 is lifted off from the stop 15 again, so that the trailing tooth flank of the tooth of the second gearwheel 5 is pressed with a defined force against the leading tooth flank of the tooth of the first gearwheel 3 by the setting drive 10 acting as a compressed-air spring.

A subsequent sixth method step involves the printing operation according to the first operating mode of the rotary printing machine. The bracing of the second gearwheel 5 relative to the first gearwheel 3 prevents a tooth-flank change which, without the measures described, would be caused by the unbalance of the second cylinder 2 that is brought about by a circumferentially open cylinder gap of the second cylinder 2. A clamping and tensioning system for clamping and tensioning the flexographic printing plate and the rubber blanket is arranged in the cylinder gap.

When the second gearwheel 5 is in the first position and is braced relative to the first gearwheel 3, the second portion 13 of the traction means 7 functions as the load portion of the traction means 7. In this case, the tension force exerted on the traction means 7 by the setting drive 10 via the second tension element 11 exceeds the sum of the tension force applied to the traction means 7 by the spring 8 via the first tension element 9 and the force of an unbalance moment that results from the unbalance of the cylinder gap. If, however, the contact surface 14 is lifted off from the stop 15 and the tooth of the second cylinder 2 is in the middle position in relation to the tooth space of the first cylinder 1, then the first portion 12 functions as the load portion of the traction mechanism 7. A spring force of the spring 8 applying the tension force of the tension element 9 is approximately 1.8 times higher than the resultant tractive force (belt force) in the traction means 7. The tractive force is determined by the unbalance of the cylinder gap and by the associated lever arm, to be precise the radius of the second cylinder 2.

The roller 16 and the third wheel 17 shown in FIG. 2 are positively driven solely by the traction means 7 in both the first operating mode and the second operating mode of the rotary printing machine, that is to say both during the printing operation and during the straightforward sheet transport operation of the coating unit shown in FIG. 2. A gearwheel for the rotary drive comparable to the gearwheels 3 and 5, therefore advantageously does not need to be assigned to the metering roller 16.

We claim:

1. A rotary printing machine, comprising:

a first gearwheel;

a second gearwheel;

a setting device for selectively adjusting said second gearwheel into a first position in which said second gearwheel is coupled with said first gearwheel and into a second position in which said second gearwheel is uncoupled from said first gearwheel; and a traction mechanism for securing a staggered-teeth rotary-angle position of said second gearwheel relative to said first gearwheel when said second gearwheel is adjusted into the second position;

said traction mechanism including a rotatably configured traction device;

said traction mechanism including a first tension element for tensioning said traction device;

said traction mechanism including a spring that loads said first tension element;

said traction mechanism including a second tension element assigned to said traction device; and said second tension element being mounted to be selectively adjustable into a first switching position and a second switching position.

2. The rotary printing machine according to claim 1, comprising a stop that predetermines the first switching position.

3. The rotary printing machine according to claim 2, wherein said stop is an adjustable stop.

4. The rotary printing machine according to claim 1, comprising:

a setting drive assigned to said second tension element;

said setting drive for adjusting said second tension element into the first switching position and into the second switching position.

5. The rotary printing machine according to claim 4, wherein said setting drive is a pneumatic working cylinder.

6. The rotary printing machine according to claim 1, wherein said second tension element is a tension roller.

7. The rotary printing machine according to claim 1, wherein:

said traction device rotates along a path; and said first tension element is configured inside the path.

8. The rotary printing machine according to claim 1, wherein:

said traction device has a first portion and a second portion;

said first tension element is assigned to said first portion of said traction device; and said second tension element is assigned to said second portion of said traction device.

9. The rotary printing machine according to claim 1, wherein:

said traction device rotates along a path; and said second tension element is disposed inside the path.

10. The rotary printing machine according to claim 9, wherein:

said second gearwheel is disposed outside the path.

11. The rotary printing machine according to claim 9, wherein:

said first gearwheel is disposed inside the path.

* * * * *